US006918523B1

(12) United States Patent
Chou

(10) Patent No.: US 6,918,523 B1
(45) Date of Patent: Jul. 19, 2005

(54) NAILER WITH IMPROVED SPACER ACTUATOR

(75) Inventor: Chien-Chi Chou, Chang Hua Hsien (TW)

(73) Assignee: Yong Song Hardware & Tool Co., Ltd., (TW)

( * ) Notice: Subject to any disclaimer, the term of this patent is extended or adjusted under 35 U.S.C. 154(b) by 0 days.

(21) Appl. No.: 10/785,037

(22) Filed: Feb. 25, 2004

(51) Int. Cl.[7] ..... B25C 7/00
(52) U.S. Cl. ..... 227/18; 227/119; 227/136
(58) Field of Search ..... 227/15, 18, 135, 227/120, 119, 136

(56) References Cited

U.S. PATENT DOCUMENTS 3,595,460 A * 7/1971 Pitkin ..... 227/32
6,273,315 B1 * 8/2001 McGuinness et al. ..... 227/18
6,302,310 B1 * 10/2001 Lamb ..... 227/119
6,471,107 B2 * 10/2002 Liu et al. ..... 227/18
6,481,610 B1 * 11/2002 Liu et al. ..... 227/18
6,508,392 B1 * 1/2003 Huang ..... 227/18
6,543,666 B1 * 4/2003 Huang ..... 227/18
6,659,326 B2 * 12/2003 Huang ..... 227/18

* cited by examiner

*Primary Examiner*—Scott A. Smith
(74) *Attorney, Agent, or Firm*—Alan D. Kamrath; Nikolai & Mersereau, P.A.

(57) ABSTRACT

A nailer includes a nailer body and a spacer actuator design. The spacer actuator design has a container tube and a flexible propelling unit. A liftable cover is screwed into the top of a container tube. In the case of a closing state of the cover, the hollow trough cover can be connected to the open-top hollow tube of the container tube. A L-shape guide trough is mounted at one side wall of the hollow trough and a wedge groove is placed at the end of L-shape guide trough, where a vertical guide trough is provided at one side wall of the container tube's hollow tube. In the case of a closing state of the cover, the top end of the vertical guide trough will be connected to L-shape guide trough. A propelling unit includes a propelling block, a spring and a control board, of which the spring is mounted between the control board and inner wall of hollow trough to push down the propelling block flexibly. The outer face of the control board is provided with a toggle switch that protrudes from L-shape guide trough.

5 Claims, 9 Drawing Sheets

NAILER WITH IMPROVED SPACER ACTUATOR

RELATED U.S. APPLICATIONS

Not applicable.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention relates generally to a nailer, and more particularly to a nailer with an improved spacer actuator design.

BACKGROUND OF THE INVENTION

The conventional nailer is generally designed with a spacer structure whereby a container tube is placed nearby the nailer body to accommodate the spacer. And, a flexible propelling block is placed at the top of container tube to push down the spacer flexibly. However, the following disadvantages shall be addressed during applications:

As the flexible propelling block is available with a rod-like shape, the top end of the propelling block will protrude from the top of the container tube in the presence of many spacers within the container tube. Therefore, the distortion of the top end is possible due to the collision when the nailers are operated by the workers or placed on site. In such case, the operational work will be adversely affected or disrupted for unexpected maintenance or replacement.

Based upon the aforementioned disadvantages of the spacer structure of conventional nailer, this industry shall assume the responsibility to make pioneering R & D and innovation for an ideal utility model.

BRIEF SUMMARY OF THE INVENTION

The present invention has offered an improved efficiency as detailed below:

1. To provide a flexible propelling unit 20 that is placed into a liftable cover 30. The propelling block is designed with an innovative structure whereby the fixation or operation is subjected to the control of an adjustable control board 23. This is a preferred option of this industry in conformity with the requirements of a new patent.

2. Based upon this modified structure of nailer with improved spacer actuator design, it's possible to reduce the space considerably and avoid distortion arising from the impact of external force.

The new advantages of the present invention include:

1. The fixation or operation of the propelling block 21 as well as the compression or extending state of the spring can be achieved through the control board 23 in an effective manner.

2. Based upon the structural design that an inclined plane 15 is provided at the top end of the container tube 10, it can be seen that, the cover 30, which is opened with a preset angle, will be fixed when one side abuts upon the inclined plane 15.

DETAILED DESCRIPTION OF THE INVENTION

The features and the advantages of the present invention will be more readily understood upon a thoughtful deliberation of the following detailed description of a preferred embodiment of the present invention with reference to the accompanying drawings.

Figure 1:
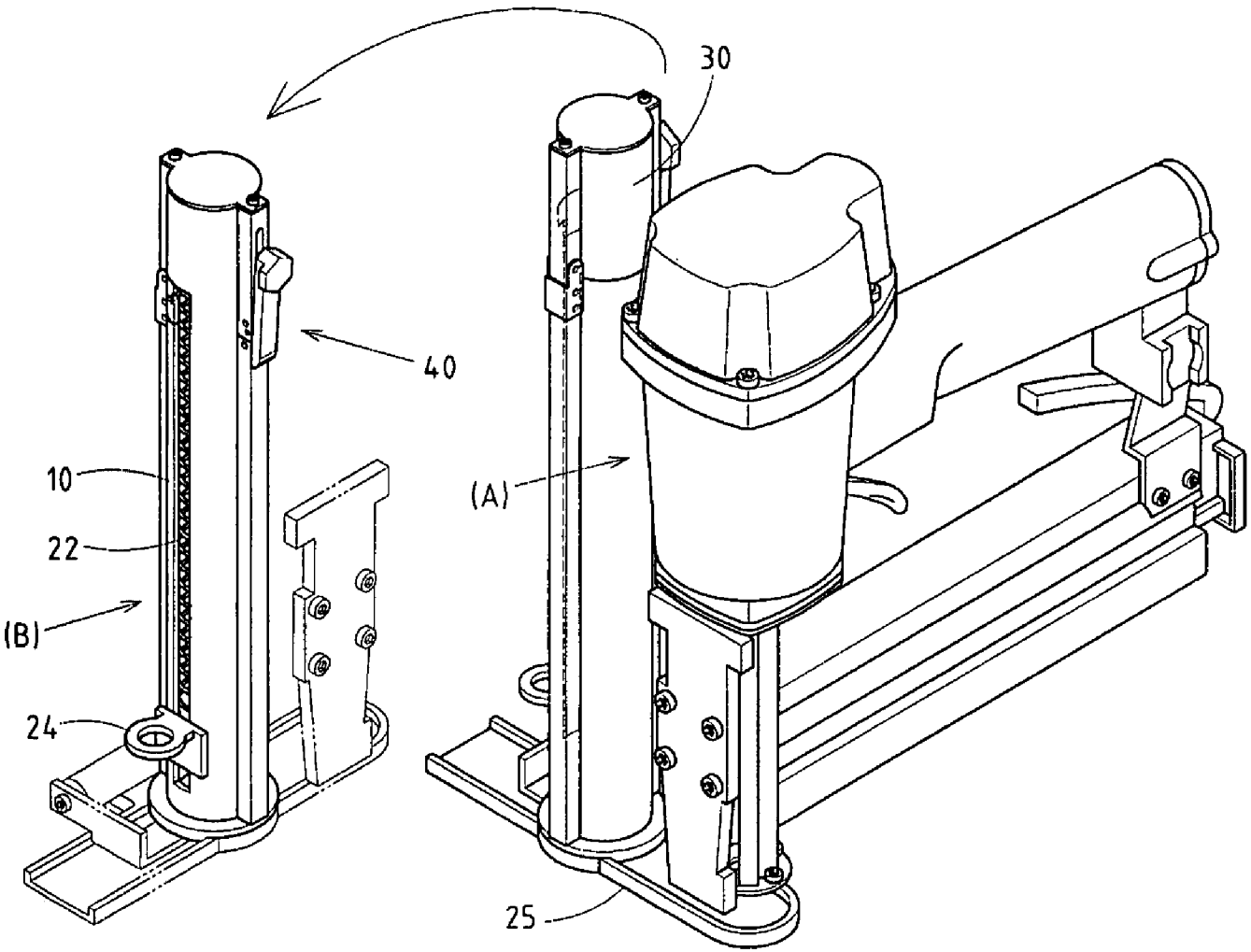
FIG. 1 shows a perspective view of the present invention.
Figure 2:
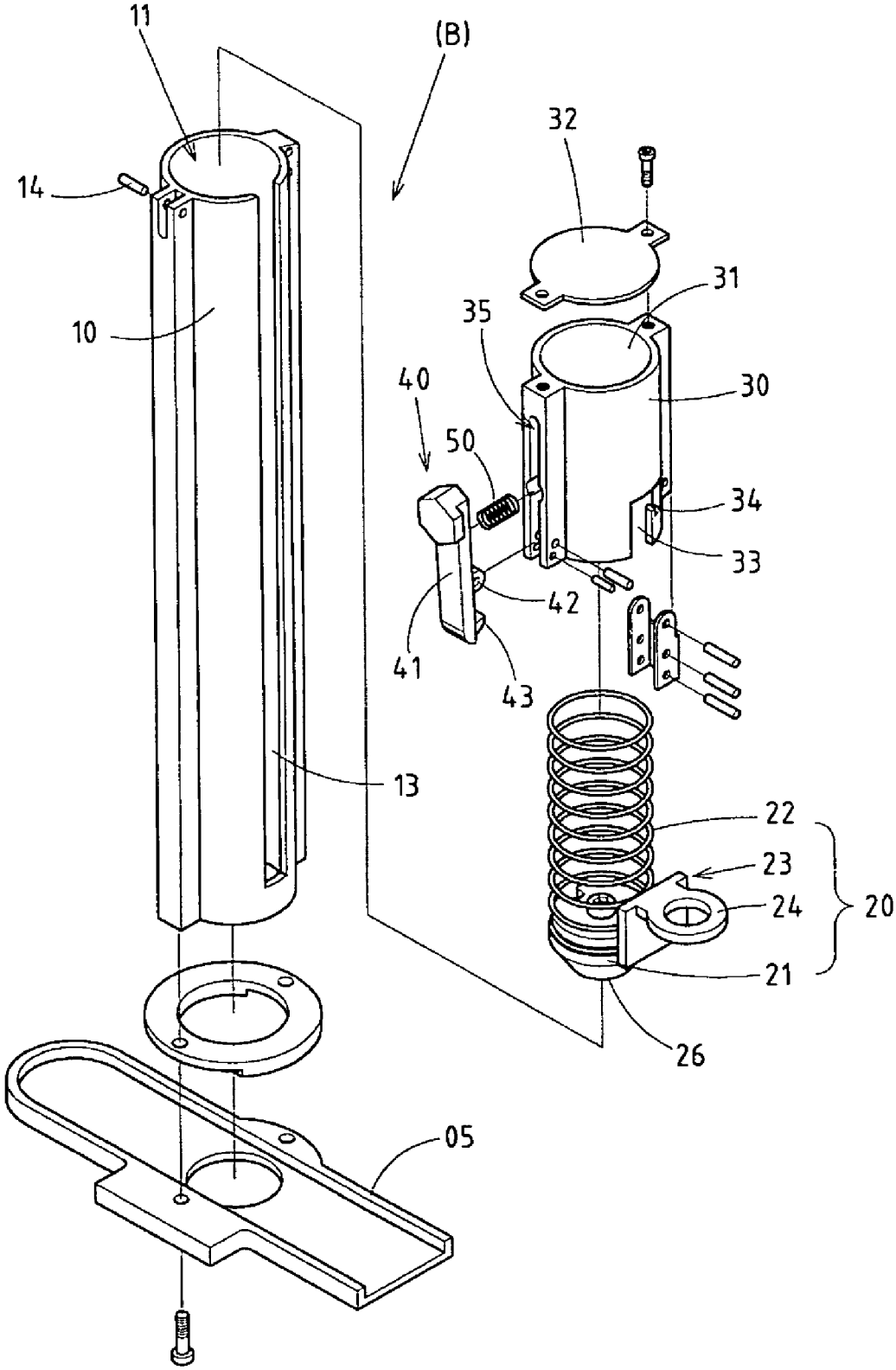
FIG. 2 shows an exploded perspective view of the present invention.
Figure 3:
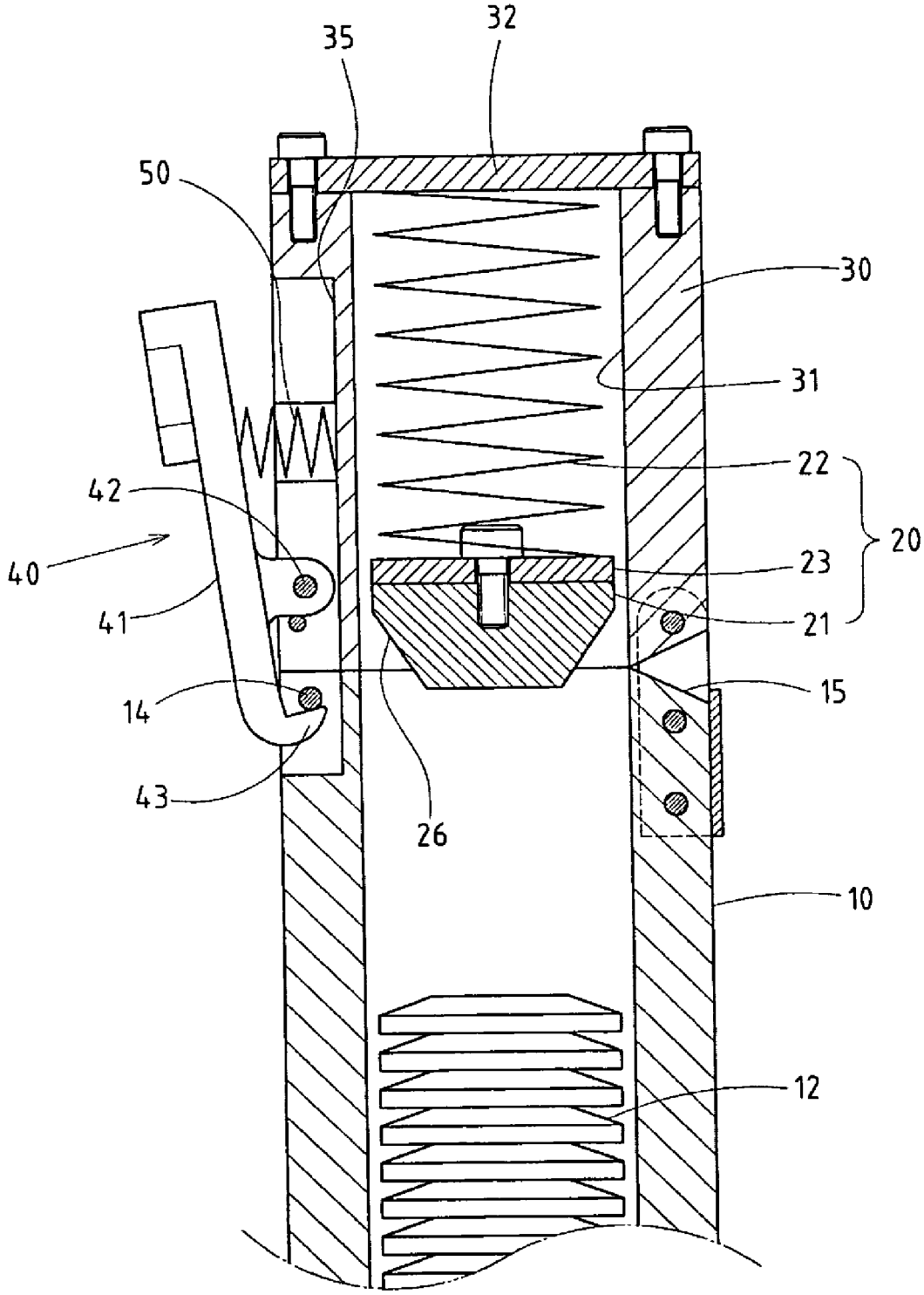
FIG. 3 shows a cross-sectional view 1 of a propelling block fixed in the cover.

As shown in FIGS. 1–3, a nailer embodied in the present invention comprises: a nailer body A and a spacer actuator design B, of which the spacer actuator design B generally comprises a container tube 10 and a flexible propelling unit 20. The hollow tube 111 of the container tube 10 is used to superpose the spacers 12 of the nailer. And, the bottom of the container tube 10 shall be fastened securely to a preset pedestal board 05 at the bottom of the nailer A, where the spacer 12 at the base of container tube 10 will move towards the outlet of the nailer A. The features include:

There is a liftable cover 30, which allows a shaft axle to screw one side into the top of the container tube 10. In the case of a closing state of the cover 30, the hollow trough 31 will align itself with the open hollow tube 11 of the container tube 10. An enclosed surface 32 is arranged at the top of the hollow trough 31 while an L-shape guide trough 33 is mounted at one side wall of the hollow trough 31. Moreover, a wedge groove 34 is placed at the end of L-shape guide trough 33, where a vertical guide trough 13 is provided at one side wall of the container tube's 10 hollow tube 11. In the case of a closing state of the cover 30, the top end of the vertical guide trough 13 will be connected to L-shape guide trough 33. Still, a fixation component 40 is provided at the other side of the cover 30 to ensure the fixation of the closed cover 30.

There is also a propelling unit 20, which comprises a propelling block 21, a spring 22 and a control board 23. The propelling block 21 is placed at the bottom of the hollow trough 31 of the cover 30, the control board 23 is provided at the inner side of the propelling block 21 and the spring 22 is mounted between the control board 23 and the inner wall of hollow trough 31 to push down the propelling block 21 flexibly. The outer face of the control board 23 is provided with a toggle switch 24 that protrudes from L-shape guide trough 33. When the toggle switch 24 is inserted into the wedge groove 34 of L-shape guide trough 33, the propelling block 21 will be fixed to avert spring 22 into a compressing state; When the toggle switch 24 shifts out of the wedge groove 34 of L-shape guide trough 33, the propelling block 21 will slide downwards along the hollow tube 11 of the container tube 10 and put the spring 22 into an extending state, thereby pressing and superposing flexibly the spacers 12 within the hollow tube 11.

The fixation component 40 of the cover 30 is designed with a rotary rod hook 41. The pivot point 42 of the rod hook 41 is provided at the lower part of the middle section while the bottom hook 43 of the rod hook 41 extends to one side of the top end of the container tube 10. A spring reposition component 50 (e.g. helical spring) is provided between the inner side of the top of rod hook 41 and the concave 35 at one side of cover 30, where it can flexibly push out the top end of the rod hook 41, namely the bottom hook 43 of the rod hook 41 can flexibly rotate inwards. The container tube 10 is provided with a wedge position 14 at one side of its top end, which is used to fix the bottom hook 43 of the rod hook 41 when the latter one rotates inwards. The wedge position 14 is designed with a cross pin bolt.

Figure 7:
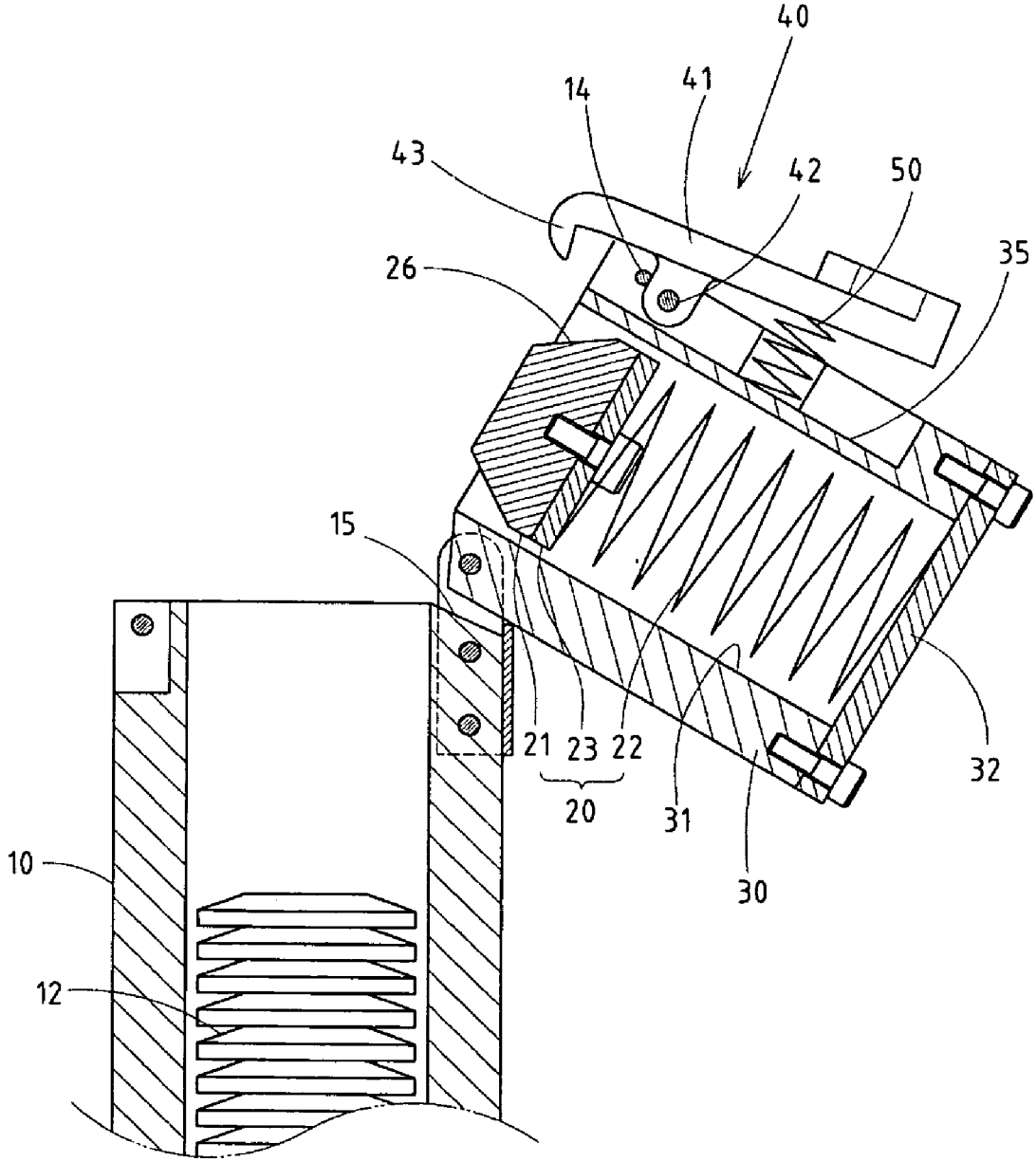
FIG. 7 shows a sectional view of an opened cover.

An everting inclined plane 15 is provided at the top end of the container tube 10 facing the connection surface of the cover 30. Thereupon, when the cover 30 is opened with a preset angle, the container tube 10 can be fixed with one side of the cover 30 abutting upon the above-mentioned inclined plane 15 (as shown in FIG. 7).

The propelling block 21 is made of rubber materials.

The peripheral bottom of the propelling block 21 is designed with a ring-shaped oblique plane 26.

Figure 8:
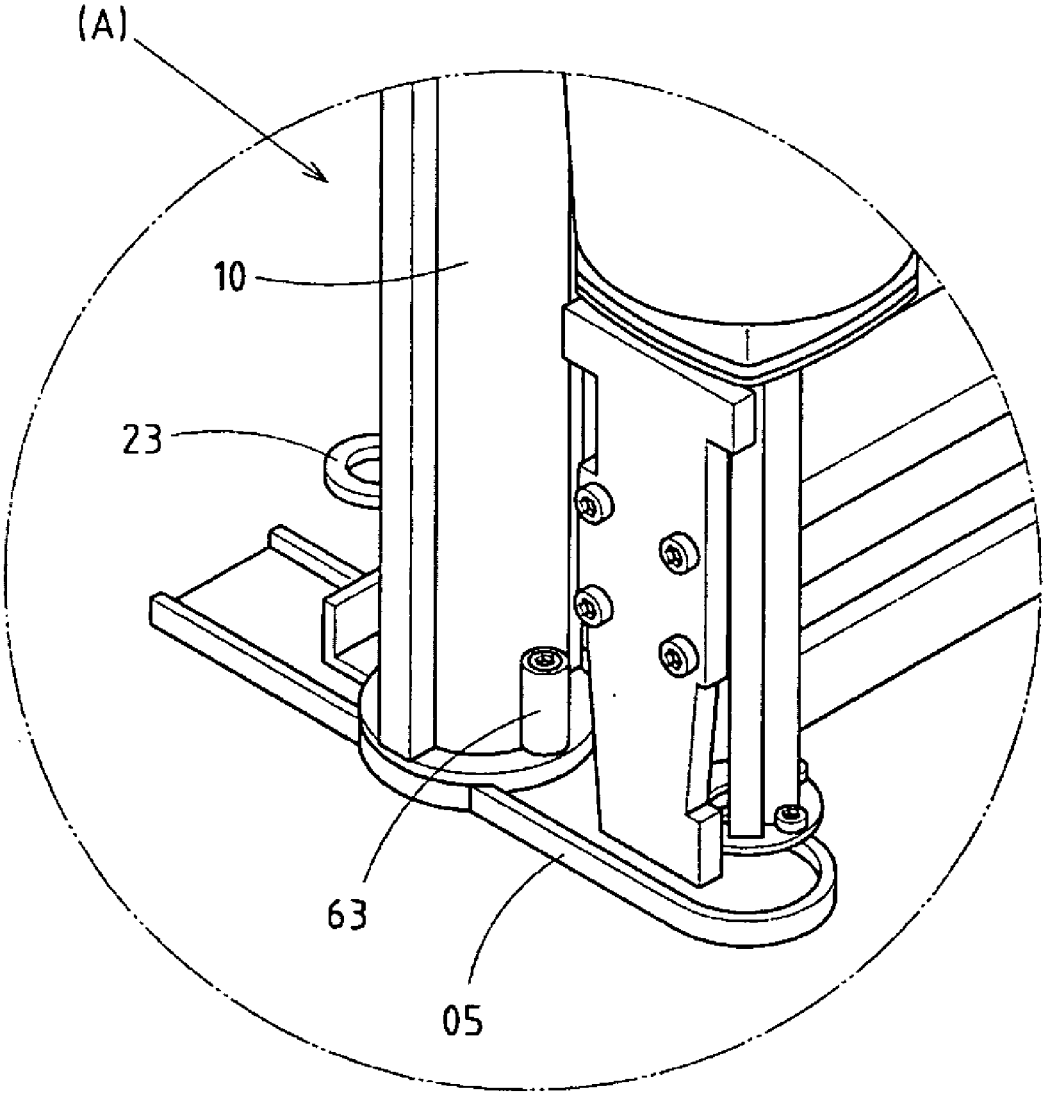
FIG. 8 shows a perspective view of another Example.
Figure 9:
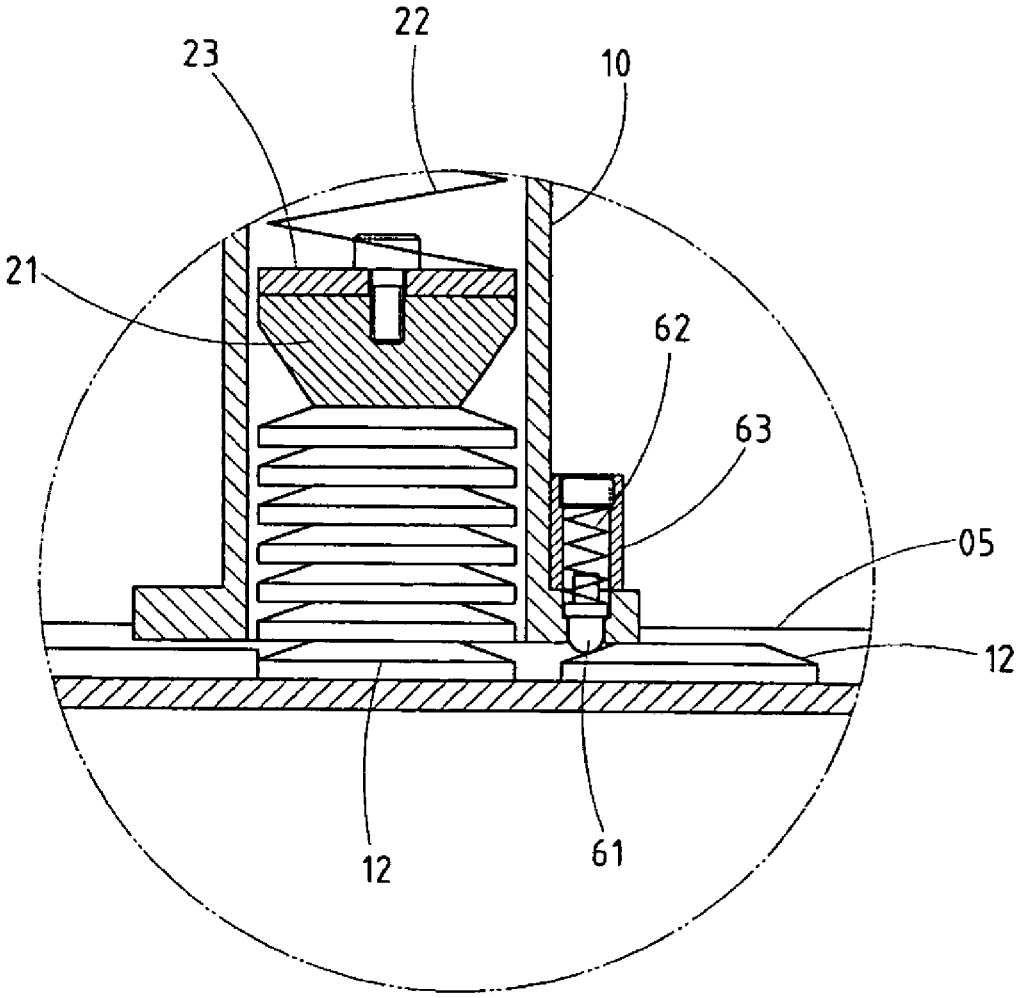
FIG. 9 shows a cross-sectional view of FIG. 8.

As shown in FIGS. 8–9, the pedestal board 05 of the nailer A is provided with a flexible spacing unit between the container tube 10 and outlet of nailer. The spacing unit comprises a fastener post 61, a spring 62 and a container base 63, of which the bottom of the fastener post 61 inserts into the pedestal board OS while its top is fastened within the container base 63 for the operation of the spring 62 under its upper wall. Thereupon, the bottom of the fastener post 61 is designed with a flexible convex, which can flexibly abut upon the spacer 12 of the pedestal board 05, so as to prevent the spacer from sliding backwards i.e. the direction of container tube.

Based upon the aforementioned structure of the present invention, the operating process of the nailer's spacer actuator design is as follows:

As shown in FIG. 3, the cover 30 of the spacer actuator design B is in a closing state. In such case, the cover 30 can be screwed and fixed into the wedge position 14 of the container tube 10 via the hook 43 of a rotary rod hook 41. And, before the spacer 12 is placed into the hollow tube 11 of the container tube 10, the end-user can use the toggle switch 24 to adjust and fix the control board 23 into the wedge groove 34 of the cover's 30 L-shape guide trough 33, thereby the spring 22 will be placed into a compressing state.

Figure 6:
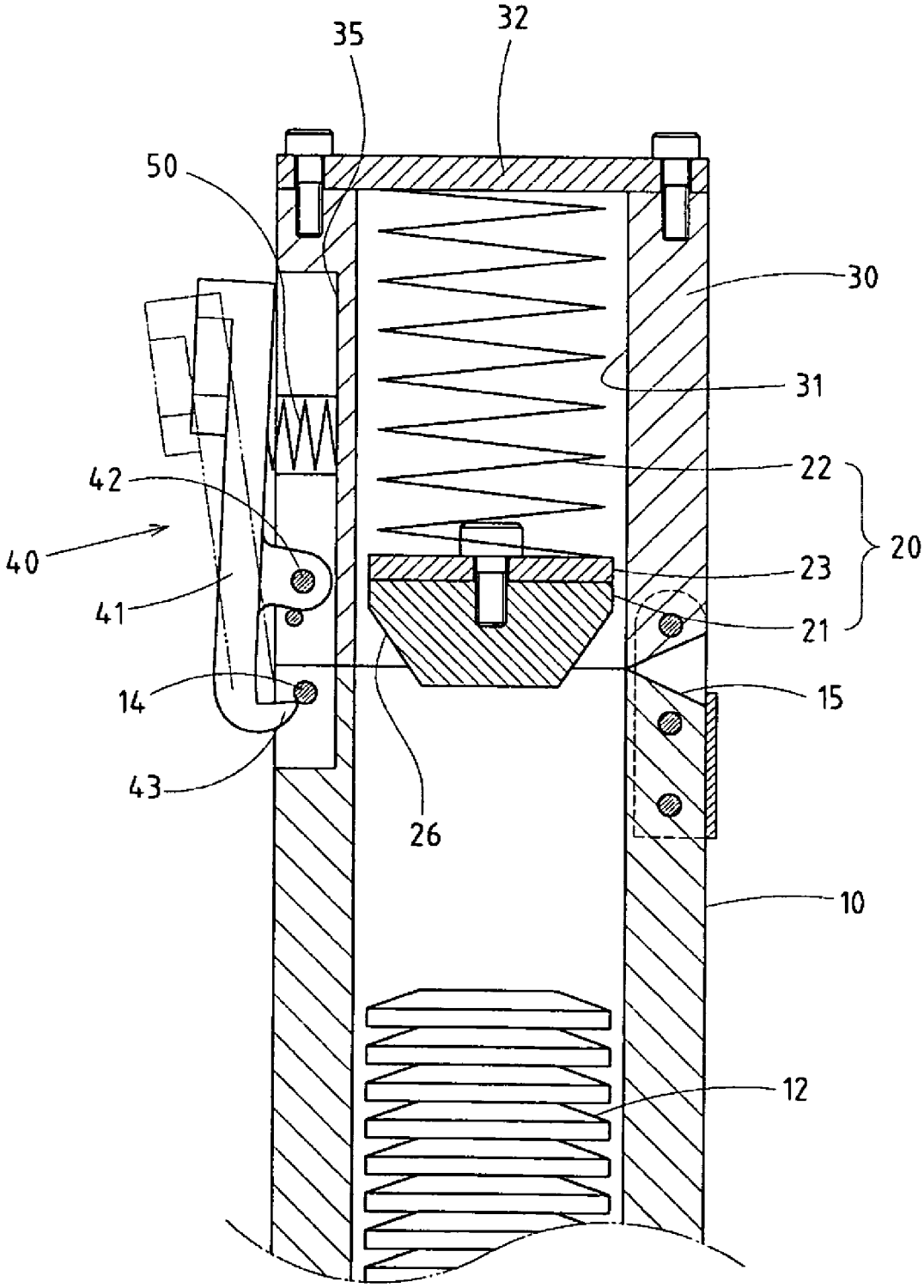
FIG. 6 shows a sectional view of a compressed rod hook.

As shown in FIG. 6, when the cover 30 is intended to be opened, you're allowed to press down the top end of the rod hook 41, thus enabling the bottom hook 43 to remove from the wedge position 14 of the container tube 10. Then, the cover 30 can be opened by the pivot point of the connection surface, so the spacer 12 can be placed into the hollow tube 11 of the container tube 10 (as shown in FIG. 7).

Figure 4:
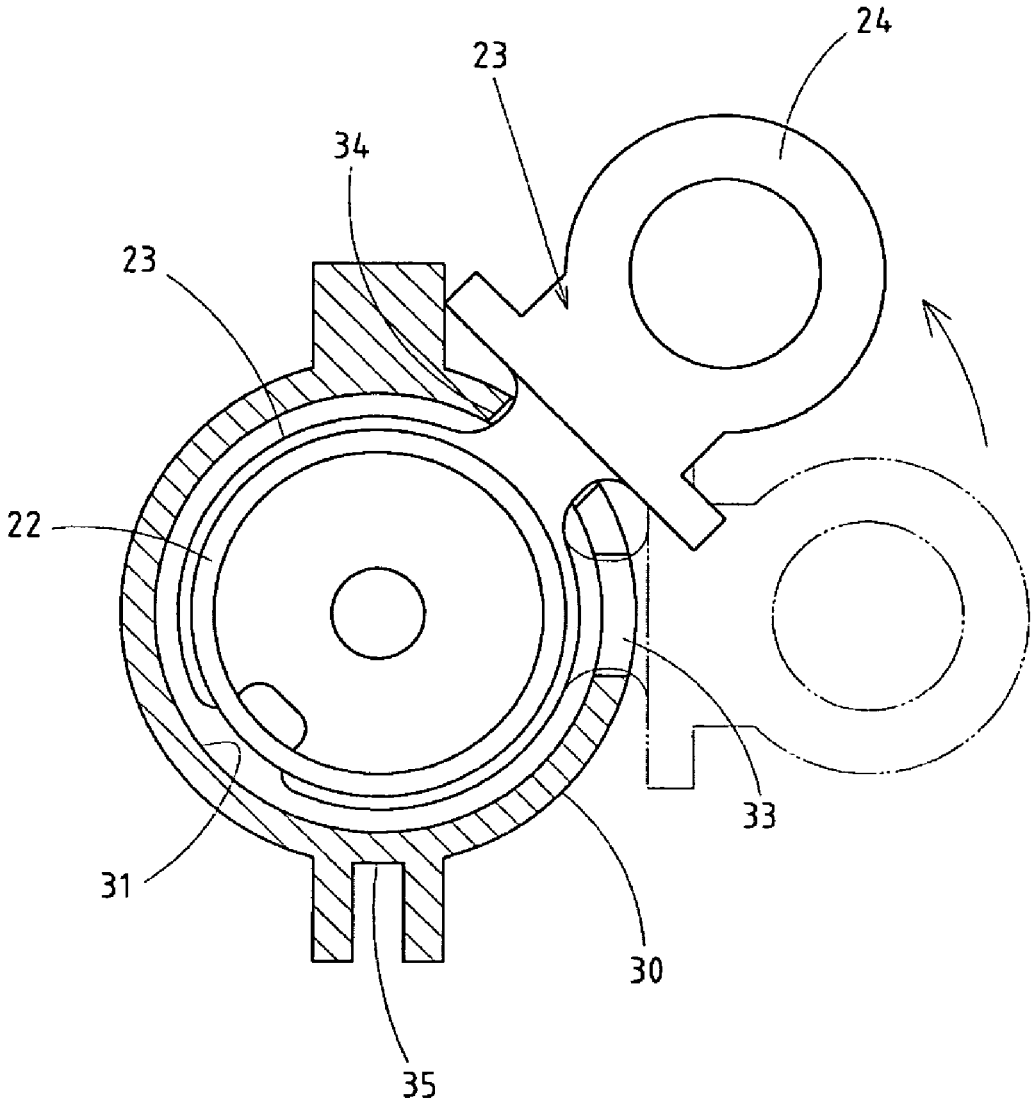
FIG. 4 shows a sectional view of a plan of a control board in an adjustable state.
Figure 5:
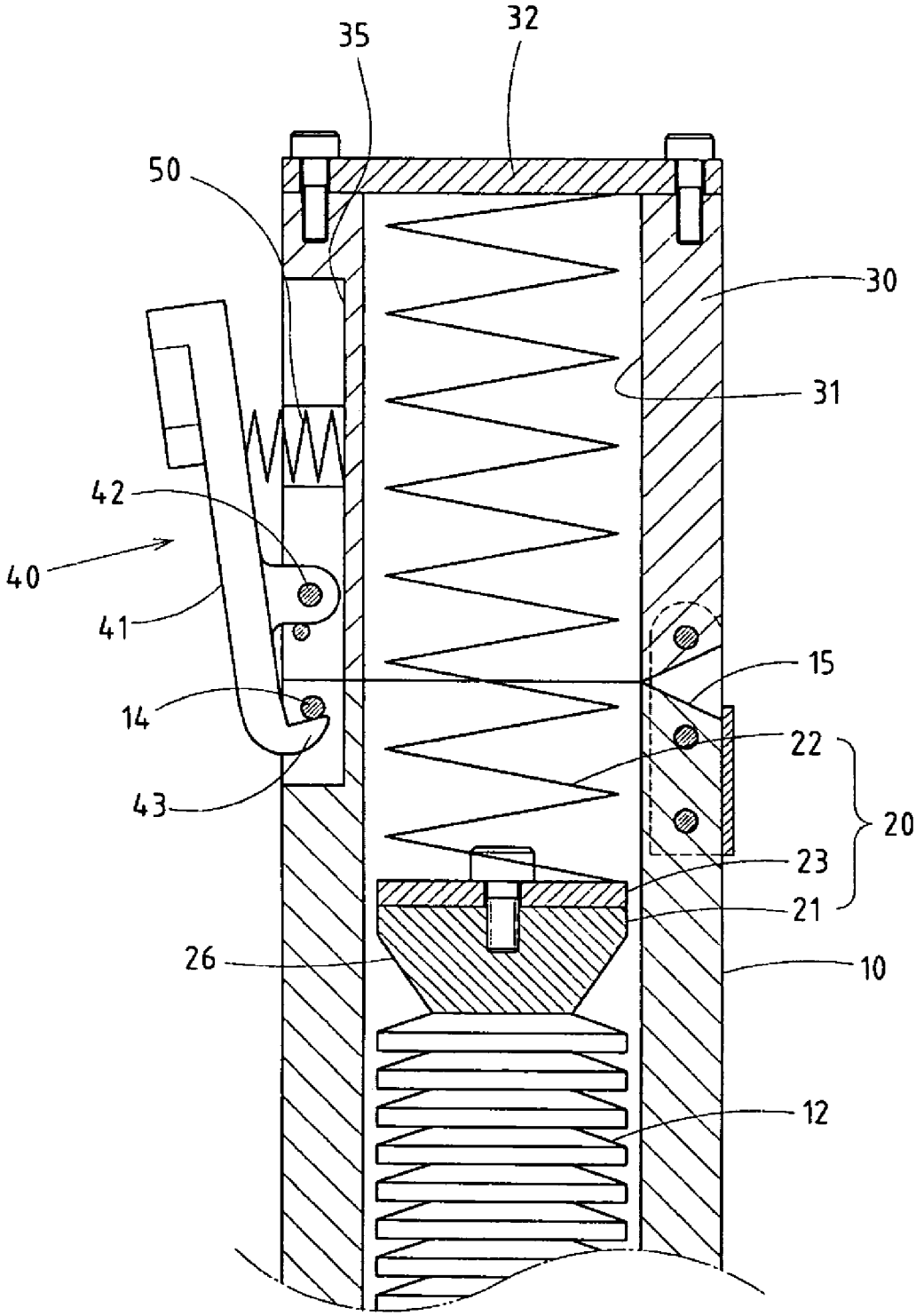
FIG. 5 shows a cross-sectional view 1 for a propelling block moving downwards.

As shown in FIGS. 4–5, when the cover 30 is in a closing state, the end-user is allowed to remove the toggle switch 24 of the control board 23 from the wedge groove 34 of L-shape guide trough 33. In this way, the non-locating propelling block 21 will slide downwards along the hollow tube 11 of the container tube 10. And, the toggle switch 24 of the control board 23 can slide downwards along a vertical guide trough 13 at one side wall of the container tube 10. Meanwhile, it will put the spring 22 into an extending state, and the propelling block 21 will be activated to press flexibly the top of spacer 12 into the hollow tube 11, thus the spacer 12 will move downwards under the pressure.

I claim:

1. A nailer with improved spacer actuator design comprising:

a nailer body with a pedestal board provided at an outlet of a bottom thereof;

a spacer actuator comprised of a container tube and a flexible propelling unit, said container tube being hollowing and being used to superpose spacers, a bottom of the container tube being fastened securely to a preset pedestal board at a bottom, where a spacer at a base of said container tube move towards said outlet a liftable cover allowing a shaft axle to screw one side into a top of the container tube; wherein in the case of a closing state of the cover, the hollow trough connects to an open-top hollow tube of the container tube, enclosed surface being arranged at the top of the hollow trough while a L-shape guide trough is mounted at one side wall of the hollow trough; and wherein a wedge groove is placed at the end of L-shape guide trough, where a vertical guide trough is provided at one side wall of the container tube's hollow tube; and wherein, in the case of a closing state of the cover, the top end of the vertical guide trough connects to L-shape guide trough, and a fixation component is provided at another side of a cover to ensure fixation thereof;

a propelling unit comprised of a propelling block, a spring and a control board, said propelling block being placed at the bottom of the hollow trough of the cover, the control board being provided at the inner side of the propelling block and the spring being mounted between the control board and inner wall of hollow trough to push down the propelling block flexibly; wherein an outer face of the control board is provided with a toggle switch that protrudes from L-shape guide trough; and wherein the toggle switch is screwed into the wedge groove of L-shape guide trough, the propelling block will be fixed to avert the spring into a compressing state; and wherein the toggle switch shifts out of the wedge groove of L-shape guide trough, the propelling block slides downwards along the hollow tube of the container tube and place the spring into an extending state, thereby pressing and superposing flexibly the spacers within the hollow tube.

2. The spacer actuator design of a nailer defined in claim 1, wherein a fixation component of the said cover is comprised of a rotary rod hook, a pivot point of the rod hook being provided at the lower part of the middle section while the bottom hook of the rod hook extends to one side of the top end of the container tube; and wherein a spring reposition component is provided between the inner side of the top of rod hook and the concave at one side of the cover, where it can flexibly push out the top end of the rod hook, namely the bottom hook of the rod hook can flexibly rotate inwards, said container tubes being provided with a wedge position at one side of its top end, which is used to fix the bottom hook of the rod hook when the latter one rotates inwards.

3. The spacer actuator design of a nailer defined in claim 1, wherein an everting inclined plane is provided at the top end of the container tube facing the connection surface of the said cover; wherein when the cover is opened with a preset angle, the container tube can be fixed with one side of the cover abutting upon the above-mentioned inclined plane.

4. The spacer actuator design of a nailer defined in claim 1, wherein the peripheral bottom of the said propelling block has a ring-shaped oblique plane.

5. The spacer actuator design of a nailer defined in claim 1, wherein the pedestal board of the said nailer is comprised of a flexible spacing unit between the container tube and outlet of nailer and wherein said spacing unit comprises a fastener post, a spring and a container base, of which the bottom of the fastener post inserts into the pedestal board while its top is fastened within the container base for the operation of the spring under its upper wall; and wherein a bottom of the fastener post is designed with has a flexible convex shape, which can flexibly abut upon the spacer of the pedestal board, so as to prevent the spacer from sliding backwards.

* * * * *